US009754753B2

(12) United States Patent
Hrncir, Jr. et al.

(10) Patent No.: US 9,754,753 B2
(45) Date of Patent: Sep. 5, 2017

(54) BREAKER SECONDARY TERMINAL BLOCK ISOLATION CHAMBER

(71) Applicant: EATON CORPORATION, Cleveland, OH (US)

(72) Inventors: Daniel Edward Hrncir, Jr., Fletcher, NC (US); David Aaron Metcalf, Black Mountain, NC (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/987,335

(22) Filed: Jan. 4, 2016

(65) Prior Publication Data

US 2016/0225570 A1 Aug. 4, 2016

Related U.S. Application Data

(63) Continuation of application No. 13/937,441, filed on Jul. 9, 2013, now Pat. No. 9,230,766.

(51) Int. Cl.
*H01H 71/46* (2006.01)
*H01H 71/08* (2006.01)

(52) U.S. Cl.
CPC ..... *H01H 71/46* (2013.01); *H01H 71/08* (2013.01); *H01H 2071/086* (2013.01); *H01H 2201/012* (2013.01); *Y10T 29/49002* (2015.01)

(58) Field of Classification Search
None
See application file for complete search history.

(56) References Cited

U.S. PATENT DOCUMENTS 4,603,376 A * 7/1986 Maier ..... H01R 4/36 200/284
4,928,080 A * 5/1990 Jacobs ..... H01H 9/0264 335/202
5,811,749 A * 9/1998 Bausch ..... H01H 9/342 200/306
6,152,758 A 11/2000 Matsuoka
6,172,586 B1 * 1/2001 Ferree ..... H01H 71/08 335/202
6,211,759 B1 * 4/2001 Little ..... H01H 9/0264 335/202
6,379,196 B1 * 4/2002 Greenberg ..... H01H 71/08 335/202
6,404,652 B1 6/2002 Takebayashi et al.
(Continued)

*Primary Examiner* — Xanthia C Cunningham
(74) *Attorney, Agent, or Firm* — Eckert Seamans; Carol Marmo; Philip Levy

(57) ABSTRACT

The disclosed concept pertains generally to secondary terminal blocks and, more particularly, to apparatus and methods for isolating the secondary terminal blocks and associated wiring in electrical switching assembly enclosures. The apparatus includes a housing having an outer surface structured to form a cavity therein. The apparatus is positioned in an enclosure which includes an electrical switching apparatus and one or more secondary terminal blocks. The one or more secondary terminal blocks are positioned in the cavity such that the apparatus at least substantially isolates the one or more secondary terminal blocks from the electrical switching apparatus. Further, the apparatus is effective to substantially isolate the secondary terminal blocks from temperature and pressure effects resulting from an arcing fault occurring in the enclosure.

14 Claims, 2 Drawing Sheets

(56) References Cited

U.S. PATENT DOCUMENTS 6,447,307 B1 9/2002 Wu
6,452,813 B1 * 9/2002 Gretz ..... H02G 3/126 174/651
6,736,650 B1 5/2004 Chen et al.
6,930,577 B2 * 8/2005 Subramanian ..... H01H 1/2058 200/304
7,009,126 B2 * 3/2006 Etscheidt ..... H01H 9/0264 200/293
7,554,781 B1 * 6/2009 Weeks ..... H01H 3/001 335/15
7,633,363 B2 * 12/2009 Fausch ..... H01H 50/026 335/124
8,123,533 B2 2/2012 Luo et al.
8,169,283 B2 * 5/2012 Siebels ..... H01H 9/0264 335/202
8,366,492 B2 * 2/2013 Erickson ..... H01H 71/0264 200/237
8,698,023 B2 * 4/2014 Grunwald ..... H01H 9/0264 200/303
8,853,576 B2 * 10/2014 Sisley ..... H01H 77/00 200/304
8,859,918 B2 * 10/2014 Sisley ..... H01H 9/0264 200/293
2002/0144978 A1 * 10/2002 Leone ..... H01H 9/342 218/154
2005/0094357 A1 5/2005 Ewing et al.
2007/0151078 A1 * 7/2007 Kim ..... H04M 1/0218 16/325
2008/0074217 A1 * 3/2008 Duchrow ..... H01H 9/342 335/202
2008/0246566 A1 * 10/2008 Oh ..... H01H 71/08 335/197
2009/0257174 A1 10/2009 Rane et al.
2012/0133224 A1 * 5/2012 Grosskopf ..... H01R 9/24 310/71
2012/0188668 A1 * 7/2012 Weeks ..... H01H 83/04 361/42
2013/0207494 A1 * 8/2013 Patel ..... H02K 5/225 310/71
2013/0278361 A1 * 10/2013 Weeks ..... H05K 5/02 335/6

* cited by examiner

BREAKER SECONDARY TERMINAL BLOCK ISOLATION CHAMBER

CROSS-REFERENCE TO RELATED APPLICATIONS

This application is a continuation of, and claims priority under 35 U.S.C. §120 from, U.S. patent application Ser. No. 13/937,441, filed Jul. 9, 2013, entitled "BREAKER SECONDARY TERMINAL BLOCK ISOLATION CHAMBER", the contents of which are incorporated herein by reference.

BACKGROUND

Field

The disclosed concept pertains generally to secondary terminal blocks and, more particularly, the disclosed concept pertains to apparatus and methods for isolating the secondary terminal blocks and associated wiring in electrical switching assembly enclosures.

Background Information

Electrical switching assemblies are generally well known in the art and include, for example, circuit switching devices and circuit interrupters, such as circuit breakers, contactors, motor starters, motor controllers and other load controllers. Circuit breakers are used for protecting electrical circuitry from damage due to an over current condition, such as an overload condition or a relatively high level short circuit or fault condition. Molded case circuit breakers, for example, include at least one pair of separable contacts which are operated either manually by way of a handle disposed on the outside of the case or automatically by way of an internal trip unit in response to an over current condition. In the automatic mode of operation, an electronic trip unit, for example, controls an operating mechanism that opens the separable contacts. In the manual mode of operation, the handle cooperates with the operating mechanism in order to open the separable contacts. Circuit breakers have at least one line terminal for connection to a power source and at least one load terminal for connection to a load, such as a motor. The separable contacts of the circuit breakers are internally connected to the line and load terminals. Circuit breakers may also have one or more auxiliary terminals. Such auxiliary terminals may be utilized as inputs to provide an external signal for tripping the circuit breaker. Furthermore, other such auxiliary terminals may be utilized as outputs to externally indicate the trip status of the circuit breaker.

Typically, electrical switching assemblies, e.g., circuit breakers, are contained within enclosures. The enclosures are effective to protect the electrical switching assemblies from exposure to environmental conditions. The enclosures typically include at least one circuit breaker, internal components and a terminal block positioned therein. Terminal blocks are generally known electrical connector devices which are employed for joining two or more wires to a single connection point. Terminal blocks include a plurality on input connections and a plurality of output connections for receiving a plurality of control wires. Terminal blocks are used to electrically connect or interface components of an electrical system or electrical components within a mechanical system. Terminal blocks can be used to connect control wiring among various items of equipment within an enclosure or to make connections among individually enclosed items. The terminal blocks are structurally coupled to a surface of the enclosure by using a snap-in or screw-mounted mechanism. In conventional electrical switching apparatus, one or more first terminal blocks can be used to support first components and one or more secondary terminal blocks can be used to support secondary components in secondary control circuits.

Terminal blocks are generally not very well protected from contact with personnel or foreign conducting materials. In conventional circuit breaker enclosures, the secondary terminal blocks are not isolated from the breaker compartment. As a result, the secondary terminal blocks may not be capable to withstand the temperature and pressure effects of an electrical arcing fault which occurs in the breaker compartment.

Accordingly, there is room for improvement in known electrical switching assembly, such as circuit breaker, enclosures which contain secondary terminal blocks. It is desired that a compartment, e.g., isolation chamber, be designed and developed to enclose or house the secondary terminal blocks and associated wiring. This isolation chamber would be capable of isolating the secondary terminal block area from other components of the circuit breaker enclosure and, to withstand the temperature and pressure effects of an electrical arcing fault which may occur in the breaker compartment. It is further desired that the isolation chamber be adaptable to accommodate various switchgear and breaker configurations and sizes. Moreover, it is desired that the isolation chamber enhance the current arc resistant low voltage switchgear assembly by allowing personnel access to the secondary terminal blocks while maintaining the arc resistant rating.

SUMMARY

These needs and others are met by embodiments of the disclosed concept.

In accordance with one aspect of the disclosed concept, there is provided an apparatus including a housing. The housing includes an outer surface structured to form a cavity therein and at least one slot formed through the outer surface, the at least one slot is structured to receive a plurality of connecting wires. The apparatus is positioned in an enclosure which comprises an electrical switching apparatus and one or more secondary terminal blocks. The one or more secondary terminal blocks are positioned in the cavity such that the apparatus at least substantially isolates the one or more secondary terminal blocks from the electrical switching apparatus.

In certain embodiments, the housing can include a rectangular member having an a top side, bottom side, back side and pair of opposing end walls, and at least one adjustable slot formed in at least one of the pair of opposing end walls.

In accordance with another aspect of the disclosed concept, there is provided a method for at least substantially isolating one or more secondary terminal blocks from an electrical switching apparatus in an enclosure. The method includes installing an apparatus in the enclosure which is structured to house the one or more secondary terminal blocks. The apparatus includes an outer surface structured to form a cavity therein; and at least one slot structured to receive a plurality of wires. The method further includes positioning the one or more secondary terminal blocks within the cavity.

In certain embodiments, the apparatus and method are effective to substantially isolate the one or more secondary terminal blocks from high temperature and pressure conditions, e.g., gases released into the enclosure as a result of an arc fault occurring in the enclosure.

In accordance with another aspect of the disclosed concept, there is an electrical switching apparatus enclosure including a molded case having walls forming a cavity including an outer wall and an inner wall, an electrical switching mechanism contained in the cavity, one or more secondary terminal blocks, and a chamber to house and isolate the one or more secondary terminal blocks. The chamber including a mounting means to couple the chamber to the inner wall of the molded case.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
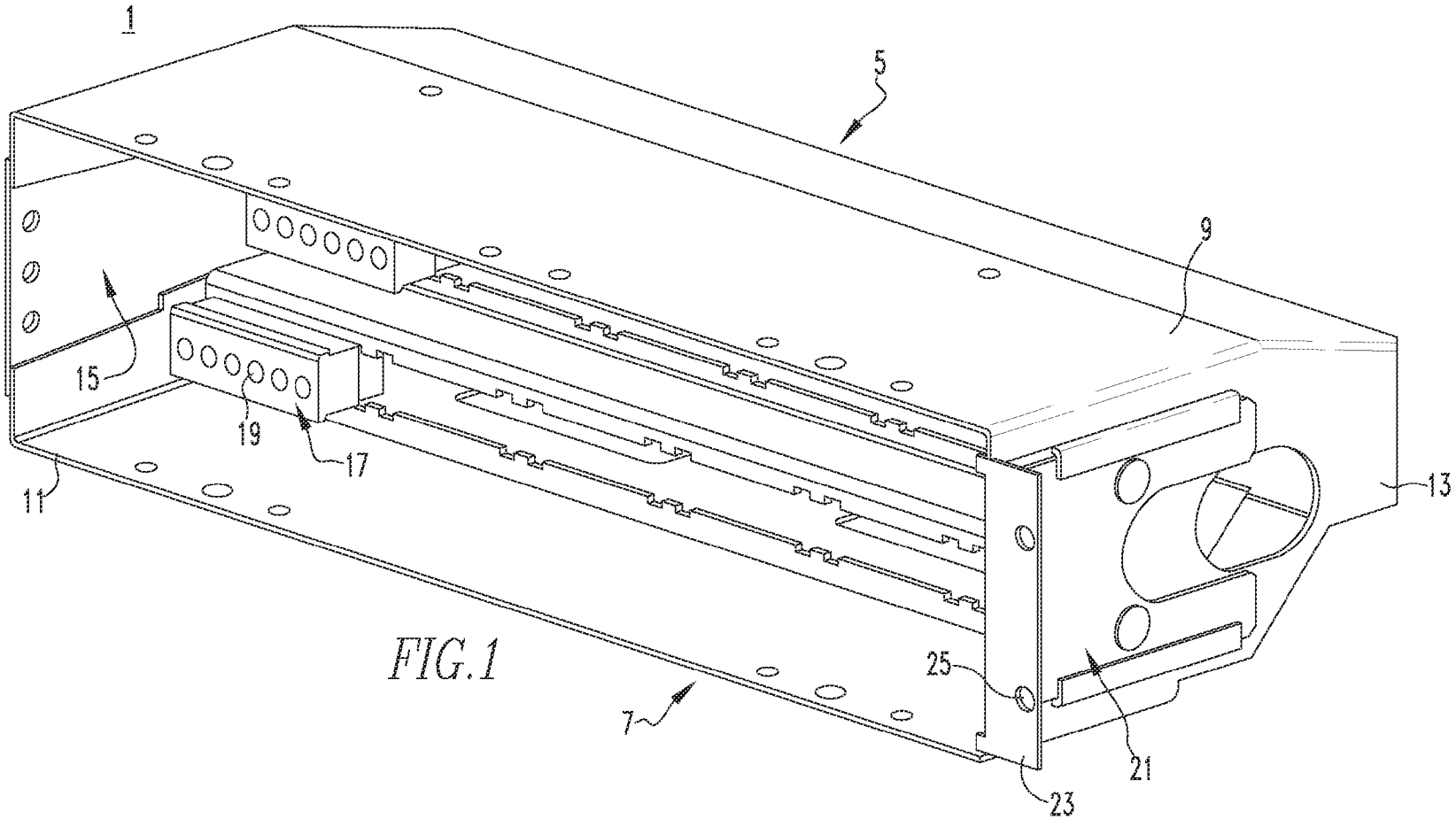
FIG. 1 is a perspective view of an isolation apparatus to house secondary terminal blocks in a circuit breaker enclosure, in accordance with certain embodiments of the invention.

Direction phrases used herein, such as, for example and without limitation, top, bottom, left, right, upper, lower, front, back and derivatives thereof, relate to the orientation of the elements shown in the drawings and are not limiting upon the claims unless expressly recited therein.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with electrical switching apparatus, such as circuit breakers, although it will become apparent that the disclosed concept could also be applied to other types of electrical switching apparatus, e.g., without limitation, other circuit switching devices and other circuit interrupters such as contactors, motor starters, motor controllers and other load controllers.

In certain embodiments, the disclosed concept includes an apparatus, e.g., chamber or compartment, for housing and/or isolating one or more secondary terminal blocks in electrical switching apparatus, such as circuit breaker, enclosures. Secondary terminal blocks are generally not isolated from other components and wiring in a typical circuit breaker enclosure.

In certain other embodiments, the disclosed concept further includes a method of installing or incorporating an apparatus, e.g., chamber or compartment, into an electrical switching apparatus enclosure. One or more secondary terminal blocks and their associated wiring are positioned within the apparatus to isolate the one or more secondary terminal blocks from other components and wiring located in the electrical switching apparatus enclosure.

In general the apparatus of the invention includes a chamber or compartment for housing one or more secondary terminal blocks. The chamber or compartment has an opening to provide access to the secondary terminal blocks. The secondary terminal blocks include connection apertures formed therein. Each of the connection apertures is structured to receive an end of a connection wire. Thus, the chamber or compartment can also at least partially house one or more connection wires. Further, the chamber or compartment includes at least one adjustable slot to allow one or more connection wires to be received into the chamber or compartment from outside thereof. The chamber or compartment is positioned in an enclosure which houses an electrical switching apparatus. The chamber or compartment isolates the secondary terminal blocks from the electrical switching apparatus and from other components that may be positioned in the electrical switching apparatus enclosure. In the event of an arcing fault occurring in the electrical switching apparatus enclosure, the chamber or compartment isolates the secondary terminal blocks from high temperature and pressure gas that typically results from the arcing fault. The chamber or compartment can also prevent the gas from exiting the electrical switching apparatus enclosure and being dissipated into the external atmosphere or environment.

FIG. 1 is an isometric view of an isolation chamber 1 in accordance with certain embodiments of the disclosed concept. The isolation chamber 1 includes a housing in the form of a rectangular member 5 having generally a trough shape which is open at a front side 7 and closed at a top side 9, bottom side 11, back side 13 (opposite to the front side 7) and a pair of opposing end walls 15, which define the rectangular member 5. The particular rectangular member 5 is not meant to be limiting and it should be understood that other types of housing members, e.g., having various shapes and sizes, may be substituted for the rectangular member 5. The particular housing member can depend on the size and configuration of the circuit breaker, the switchgear and/or the other components positioned in the circuit breaker enclosure.

The isolation chamber 1 of the disclosed concept can be constructed of a wide range of materials. Suitable materials may be selected from those materials that are known in the art for use in electrical switching assembly enclosure. The isolation chamber 1, in particular, the rectangular member 5, is typically made of a substantially rigid material. In certain embodiments, the isolation chamber 1 is at least partially constructed of a polymer and/or polymer-containing material. In particular, the isolation chamber 1 can be constructed of molded plastic. The isolation chamber can be prepared using conventional molding methods that are known in the art, such as but not limited to, injection molding.

As shown in FIG. 1, the front side 7 of the rectangular member 5 defines an opening which can function to provide access to the interior cavity defined by rectangular member 5.

Positioned within the rectangular member 5 is a pair of secondary terminal blocks 17. The two secondary terminal blocks 17 are shown in FIG. 1, however, it is contemplated that various designs and configurations of electrical switching apparatus may include one or more secondary terminal blocks 17. Each of the pair of secondary terminal blocks 17 includes a plurality of connection apertures 19. Each of the connection apertures 19 is adapted for receiving an end portion of a connection wire (not shown) and, electrically and mechanically engaging the end portion of the connection wire (not shown). An adjustable slot 21 is formed within each of the opposing end walls 15 of the rectangular member 5. Each of the adjustable slots 21 is adapted for receiving at least one connection wire (not shown), e.g., a wire harness, that is received by the plurality of apertures 19 formed in the pair of secondary terminal blocks 17. Further, as shown in FIG. 1, a vane 23 having a plurality of mounting apertures 25 formed therein is coupled to the rectangular member 5 to provide for connecting or attaching the isolation chamber 1 to a circuit breaker enclosure (shown in FIG. 2). One vane 23 is shown in FIG. 1, however, it is contemplated that various designs and configurations of electrical switching apparatus may include more than one vane 23 for mounting the isolation chamber 1 to the circuit breaker enclosure (shown in FIG. 2). Each of the mounting apertures 25 is adapted to receive an associated mounting mechanism, such as a screw or bolt (not shown). Although the vane 23 and the associated mounting mechanism (not shown) are used to couple or attach the isolation chamber 1 to the circuit breaker enclosure, e.g., interior wall, the disclosed concept contemplates using any suitable coupling and mounting mechanisms to accomplish this function.

The open front side 7 provides personnel the capability to access the secondary terminal blocks 17 and associated connection wires which are contained in the isolation chamber 1, e.g., rectangular member 5.

Figure 2:
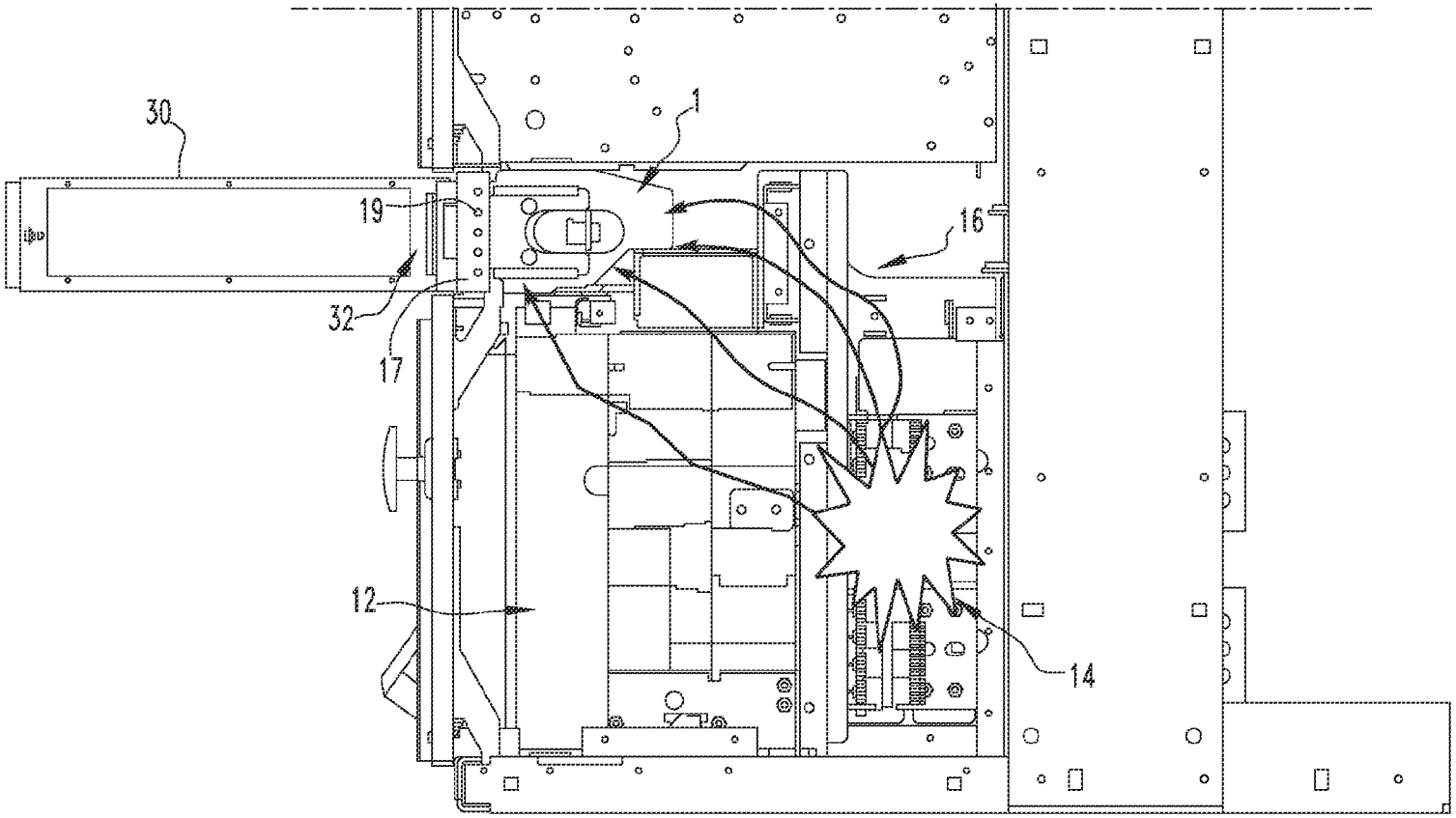
FIG. 2 is a side view of a circuit breaker enclosure including the isolation chamber of FIG. 1, in accordance with certain embodiments of the invention.

FIG. 2 is a side view of a circuit breaker enclosure 10 in accordance with certain embodiments of the disclosed concept. The circuit breaker enclosure 10 includes the isolation chamber 1 as shown in FIG. 1 including the rectangular member 5, one of the pair of secondary terminal blocks 17 and the connection apertures 19. FIG. 2 also includes a front portion 30, a personnel access point 32, a circuit breaker 12 and an arcing fault 14. The arcing fault produces increased, e.g., high, temperature and pressure gas 16. The circuit breaker enclosure 10 may house other components and equipment which are not shown in FIG. 2. As demonstrated in FIG. 2, the isolation chamber 1 is effective to house the secondary terminal blocks 17 and to at least substantially isolate the secondary terminal blocks 17 from the circuit breaker 12 and other components (not shown) which are positioned in the interior cavity or space of the enclosure 10. In the event of the arcing fault 14, the isolation chamber 1 is effective to isolate and protect the secondary terminal blocks 17 from the gas 16 which is released into the circuit breaker enclosure 10 as a result of the arcing fault 14. The gas 16 is prevented from entering the isolation chamber 1 and thereby prevented from escaping through the personnel access point 32 to the environment outside of the enclosure 10. Thus, access to the secondary terminal blocks 17 is provided while the arc resistant rating is maintained.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus, comprising:
an enclosure having an interior space;
a housing positioned within the interior space of the enclosure, the housing comprising:
an outer surface structured to form a cavity therein;
at least one slot formed through the outer surface, the at least one slot structured to receive a plurality of connecting wires; and
one or more electrical connector devices
positioned in the cavity of the housing, the one or more electrical connector devices comprising:
a plurality of connection apertures to correspondingly receive and, electrically and mechanically engage the plurality of connecting wires,
wherein, the housing isolates the one or more electrical connector devices from the interior space of the enclosure of the electrical switching apparatus which surrounds the housing.

2. The electrical switching apparatus of claim 1, wherein the housing is structured to substantially isolate the one or more electrical connector devices from temperature and pressure conditions released into the enclosure as a result of an arc fault occurring in the enclosure.

3. The electrical switching apparatus of claim 2, wherein said conditions comprise high temperature and pressure gas.

4. The electrical switching apparatus of claim 1, comprising:
a rectangular member having a front side opening, a top side, bottom side, back side, and a pair of opposing end walls; and
at least one slot formed in at least one of the pair of opposing end walls, wherein said at least one slot is adjustable.

5. The electrical switching apparatus of claim 4, wherein the housing comprises:
at least one vane for mounting the housing to an inner surface of the enclosure.

6. The electrical switching apparatus of claim 1, wherein the housing is constructed of a material selected from the group consisting of rigid and semi-rigid materials.

7. The electrical switching apparatus of claim 6, wherein the housing is constructed of a molded plastic component.

8. The electrical switching apparatus of claim 1, wherein the housing is effective to provide access to the one or more electrical connector devices while maintaining arc resistant rating.

9. The electrical switching apparatus of claim 4, wherein the front side opening allows access to the one or more electrical connector devices positioned therein.

10. A method of isolating one or more electrical connector devices in an enclosure of an electrical switching apparatus, comprising:
installing a housing in the enclosure which is structured to house the one or more electrical connector devices, the housing comprising:
an outer surface structured to form a cavity therein;
at least one slot formed through the outer surface and structured to receive a plurality of connecting wires; and
positioning the one or more electrical connector devices within the cavity of the housing, the one or more electrical connector devices comprising:
a plurality of connection apertures to correspondingly receive and, electrically and mechanically engage the plurality of connecting wires.

11. The method of claim 10, wherein the housing is effective to withstand increased temperature and pressure gas resulting from an electrical arcing fault occurring in the enclosure.

12. The method of claim 10, wherein the housing is effective to prevent the increased temperature and pressure gas from escaping the enclosure.

13. An electrical switching apparatus, comprising:
a molded case having walls forming a first cavity including an outer wall and an inner wall, and components positioned in the first cavity comprising:
an electrical switching mechanism;
a chamber comprising:
an outer surface structured to form a second cavity;

at least one slot formed through the outer surface, the at least one slot structured to receive a plurality of connecting wires;

a mounting means to couple said chamber to the inner wall of the molded case; and one or more electrical connector devices positioned in the second cavity of the chamber, the one or more electrical connector devices comprising:

a plurality of connection apertures to correspondingly receive and, electrically and mechanically engage the plurality of connecting wires.

14. The electrical switching apparatus of claim 13, wherein said electrical switching mechanism is a circuit breaker.

* * * * *